United States Patent [19]

Taylor

[11] Patent Number: 4,832,125

[45] Date of Patent: May 23, 1989

[54] WELLHEAD HANGER AND SEAL

[75] Inventor: William M. Taylor, Houston, Tex.

[73] Assignee: Cameron Iron Works USA, Inc., Houston, Tex.

[21] Appl. No.: 44,412

[22] Filed: Apr. 30, 1987

[51] Int. Cl.[4] ..... E21B 33/043

[52] U.S. Cl. ..... 166/348; 166/182; 166/208; 166/212; 166/217; 277/116.6; 277/116.8; 277/118; 277/236; 285/140; 285/382.5

[58] Field of Search ..... 166/348, 382, 85, 88, 166/115, 206–208, 212, 217, 195, 179, 182; 277/236, 117, 118, 116.2, 116.4, 116.6, 116.8, 115, 214; 285/382.5, 382.4, 382.2, 382.1, 382, 139, 140, 315; 29/523

[56] References Cited

U.S. PATENT DOCUMENTS 2,134,311 10/1938 Minor et al. ..... 285/382 X
3,282,346 11/1966 Claycomb ..... 277/116.6
4,582,134 4/1986 Gano et al. ..... 166/120
4,595,053 6/1986 Watkins et al. ..... 166/382 X
4,646,845 3/1987 Boeker ..... 166/88 X
4,665,979 5/1987 Boehm, Jr. ..... 166/217 X

FOREIGN PATENT DOCUMENTS 620892 11/1962 Belgium ..... 277/236

*Primary Examiner*—Hoang C. Dang
*Attorney, Agent, or Firm*—Vinson & Elkins

[57] ABSTRACT

An improved subsea hanger and seal having a hanger body with an external landing shoulder and an upstanding sealing rim with external sealing teeth and multiple internal camming surfaces and an actuating ring which fits within the sealing rim and includes external multiple camming surfaces mating with the camming surfaces on the interior of the sealing rim to move said sealing rim into initial set position and allow subsequent pressure to be applied to the interior of the actuating ring to deform the sealing rim into positive gripping and sealing engagement with the interior of the subsea wellhead housing in which the hanger is landed.

7 Claims, 5 Drawing Sheets

WELLHEAD HANGER AND SEAL

BACKGROUND

The present invention relates to an improved subsea wellhead hanger and seal. Prior to the present invention subsea wellhead hangers have included a shoulder which lands on the housing seat with a shoulder facing upwardly and forming the lower end of an annulus in which the hanger seal is positioned. This prior structure allows the circulation of fluids upwardly through the annular space between the hanger and the housing and through mud slots which extend through the hanger body from a position below the landing shoulder to the annulus above the shoulder. An example of this type of structure is disclosed in U.S. Pat. No. 4,550,782.

Seal structures have varied widely and include resilient annular seal which is compressed axially to expand it into sealing relation with the interior and exterior walls of the annulus. U.S. Pat. No. 3,664,689 illustrates this structure. Another form of seal includes legs which are wedged outward into sealing engagement with the walls as shown in U.S. Pat. Nos. 4,595,053 and 4,131,287. These seals provide a metal-to-metal seal.

SUMMARY

The improved subsea hanger and seal includes a hanger body with an external landing shoulder and an upstanding sealing rim having external sealing lands and grooves and multiple internal camming surfaces and also includes an actuating ring which fits within the sealing rim and includes external multiple camming surfaces mating with the camming surfaces on the interior of the sealing rim.

An object of the present invention is to provide an improved subsea wellhead hanger and seal which provides an improved metal-to-metal seal with the interior of the housing in which the hanger is landed.

Another object is to provide an improved subsea wellhead hanger and seal having a minimum of components.

A further object is to provide an improved subsea wellhead hanger and seal which has a metal deforming sealing engagement with the housing interior but is readily recoverable.

BRIEF DESCRIPTION OF THE DRAWINGS

These and other objects and advantages of the present invention are hereinafter set forth and explained with reference to the drawings wherein.

DESCRIPTION OF THE PREFERRED EMBODIMENT

Figure 1:
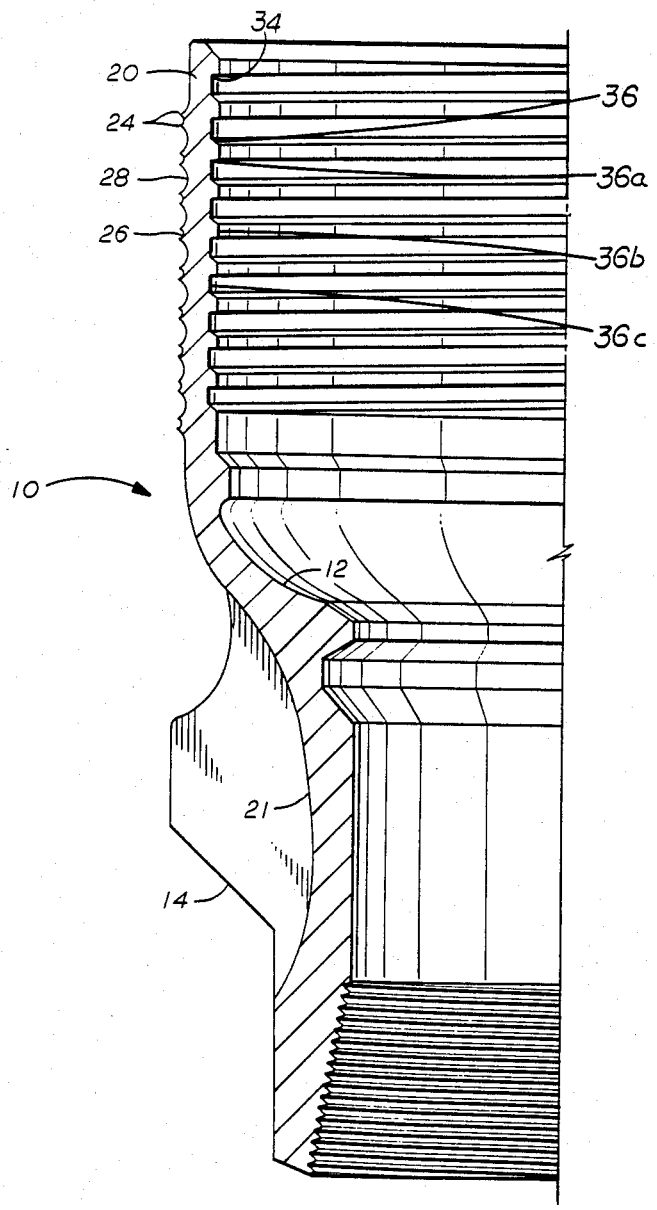
FIG. 1 is a partial sectional view of the improved hanger and sealing member of the present invention with its actuating ring omitted for clarity.
Figure 2:
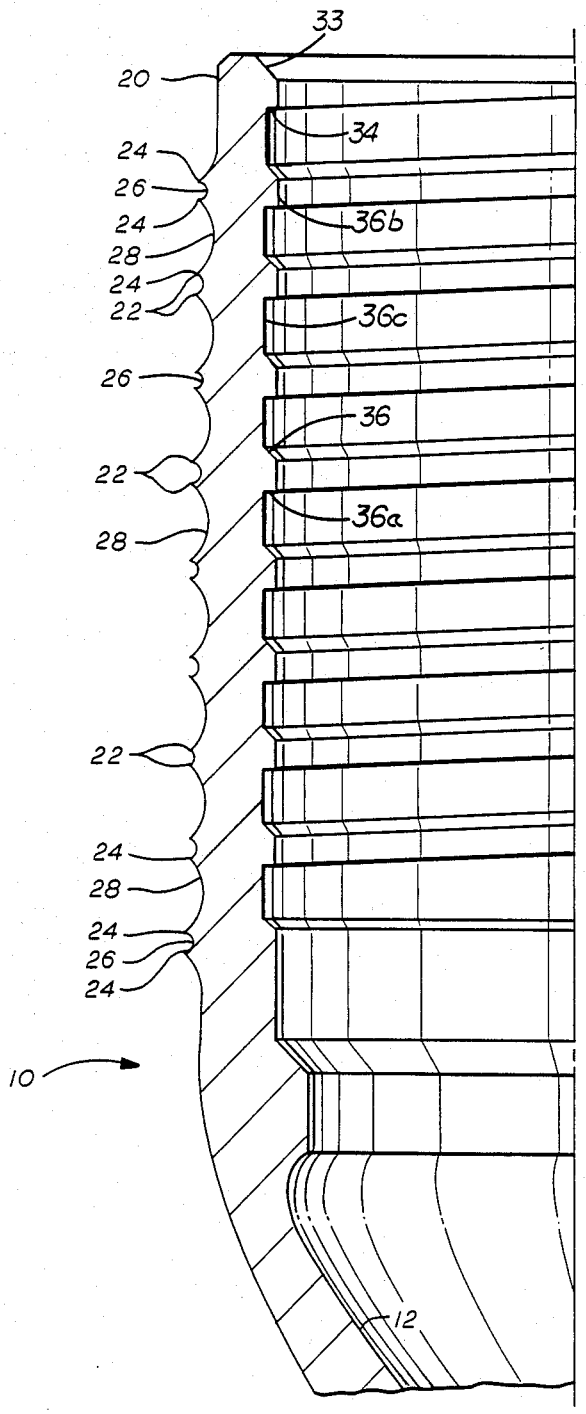
FIG. 2 is a detailed sectional view of the sealing member portion of the hanger with its actuating ring omitted for clarity.

Hanger 10 illustrated in FIGS. 1 and 2 includes body 12 having external landing shoulder 14 which is adapted to land on landing seat 16 within subsea wellhead housing 18 (FIG. 3) and further has upstanding rim 20. Mud slots 21 extend through hanger 10 in the area of landing shoulder 14 to allow circulation of fluids, such as cement, upwardly between hanger 10 and housing 18.

Rim 20, as best detailed in FIG. 2, extends arcuately upwardly and outwardly from body 12 to a position at which it runs parallel to the interior of wellhead housing 18. The exterior of rim 20 includes a plurality of spaced annular pairs of sharp ridges 22 with each sharp ridge or tooth 24 being separated by a short annular groove 26 having sufficient depth to provide the desired sharpness of teeth 24 and each pair is separated by annular groove 28 which is of a longer radius than groove 26 and extends deeper into rim 20. As hereinafter explained, ridges 22 and grooves 26 and 28 are in the form of threads extending around the exterior of rim 20. The upper end of rim 20 includes tapered surface 33 which is tapered downwardly and inwardly. The interior of rim 20 includes lower shoulder 34 and multiple camming surfaces 36 which extend around the interior of rim 20 as threads having an upper surface 36, a lower surface **36*a*, an outer surface 36*b* and a recess surface 36*c* which are on the portions of rim 20 immediately opposite ridges 22**.

Figure 3:
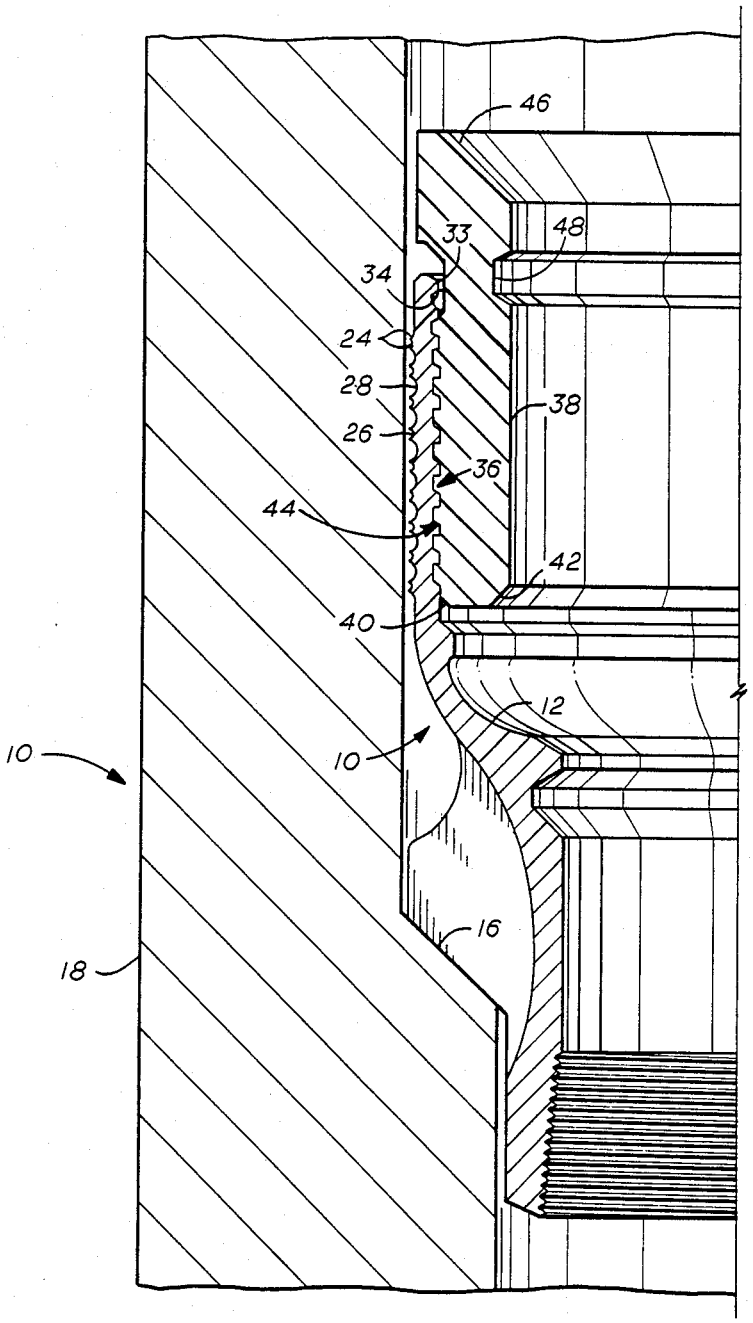
FIG. 3 is a partial sectional view of the improved hanger and seal landed within the housing against which the seal is to be made but with the forming tool omitted.

Actuating ring 38, shown in FIGS. 3, 4 and 5 includes lower outer tapered surface 40, lower inner tapered surface 42, external multiple camming surfaces 44 which mate and coact with camming surfaces 36 on the interior of rim 20 as hereinafter described. Upper internal surface 46 tapers downwardly and inwardly to provide a landing seat upon which subsequently run hangers can land and internal groove 48 which can be used by well tools to locate actuating ring 38 and to support it during running or retrieving from the well.

Figure 4:
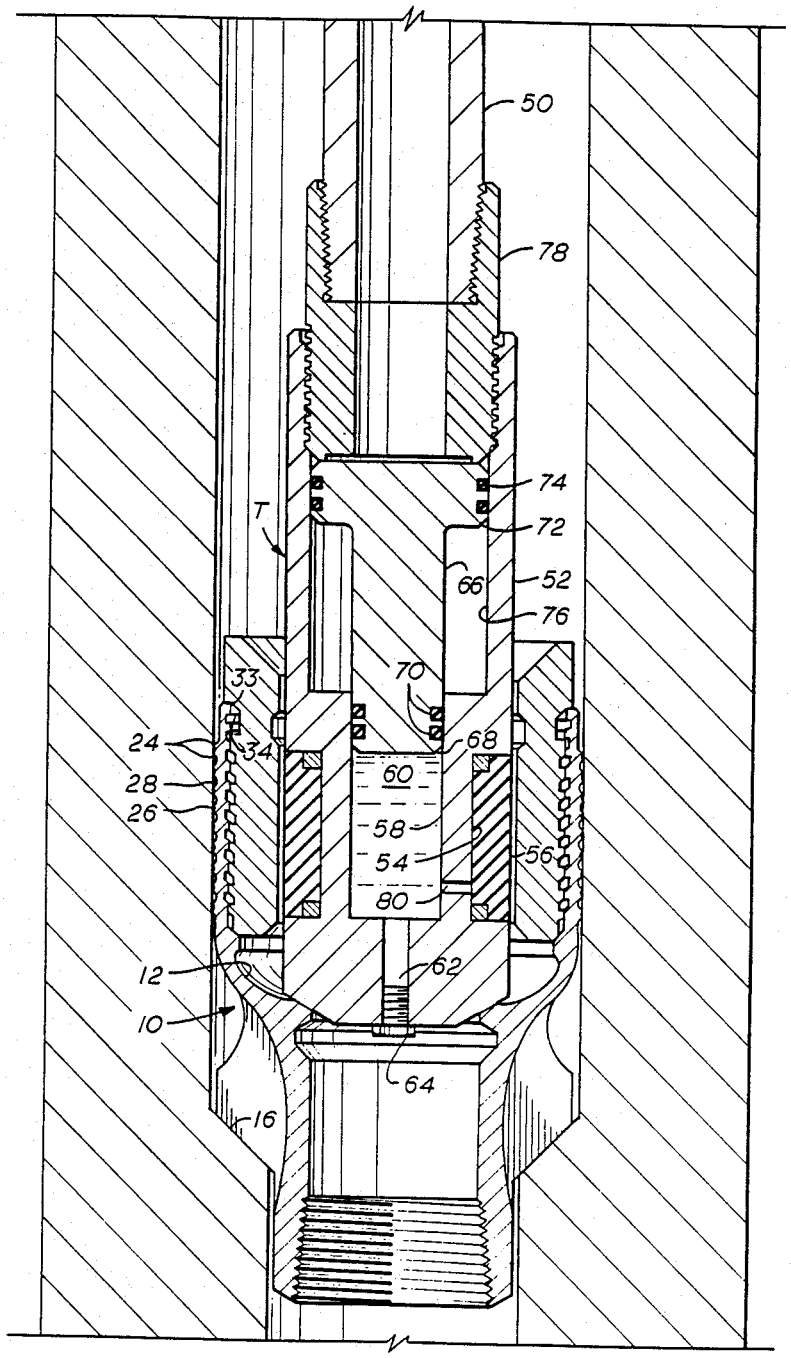
FIG. 4 is a partial view of the hanger during the forming step and shows the forming tool therein.

After hanger 10 has been landed and cemented in place, then actuating ring 38, which has been installed within rim 20 by threading it therein prior to the running of hanger 10, is moved downwardly into position within rim 20 as shown in FIG. 4. During this movement camming surfaces 44 on actuating ring 38 coact with camming surfaces 36 on the interior of rim 20 and force rim 20 outward into light engagement with the interior surface of wellhead housing 18. This is preferably accomplished by the lowering of forming tool T within hanger and landing on the upper end of actuating ring 38. Either during or after actuating ring 38 is moved to its set position, forming tool T supplies pressure to the inner surface of actuating ring 38. The operation of the forming tool T is hereinafter described in detail. The pressure supplied is sufficient to deform rim 20 so that teeth 24 engage and dig into the inner surface of wellhead housing 18. The amount of pressure can be preselected or a suitable telltale device such as a ring of brittle material can be placed in a groove around the exterior of actuating ring 38 to provide a noise indication of the completion of the forming step.

Forming tool T is lowered into position within hanger 10 as shown in FIG. 4 on running string 50. Forming tool T includes tubular body 52 which is closed at its lower end, includes annular recess 54 in which resilient annular packing 56 is positioned. Bore 58 formed on the interior of body 52 within packing 56 is filled with suitable hydraulic fluid 60. Such filling is accomplished through opening 62 which is closed by plug 64 threaded into opening 62. Piston 66 is positioned within forming tool T and includes lower end 68 surrounded by seals 70 which is positioned within the upper end of bore 58 and the upper end 72 of piston 66, which is substantially larger than the lower end 68, is surrounded by seals 74 and is within counterbore 76. Ring 78 is threaded into the upper end of forming tool T and forms the stop for the upper limit of movement of piston 66. Ring 78 has upper internal threads into which string 50 is connected to both support tool T and to provide a conduit for the delivery of fluid under pressure thereto. While not shown, forming tool T may have a flange extending outwardly from body 52 which engages the upper portion of actuating ring 38 to apply the downward pressure for moving actuating ring 38 and also properly locates packing 56 within actuating ring 38 so that the forming pressure is supplied over substantially the entire interior of the actuating ring 38.

In operation of forming tool T, it is only necessary to have it properly positioned with respect to the interior of actuating ring 38 and then to supply fluid under pressure through string 50. This pressure is exerted on the upper surface of piston 66 to urge piston 66 downwardly so that the lower surface of piston 66 forces the hydraulic fluid through port 80 to urge packing 56 outward and thus cold forge actuating ring 38 outward together with rim 20 to provide the tight gripping and sealing engagement between hanger 10 and housing 18.

Figure 5:
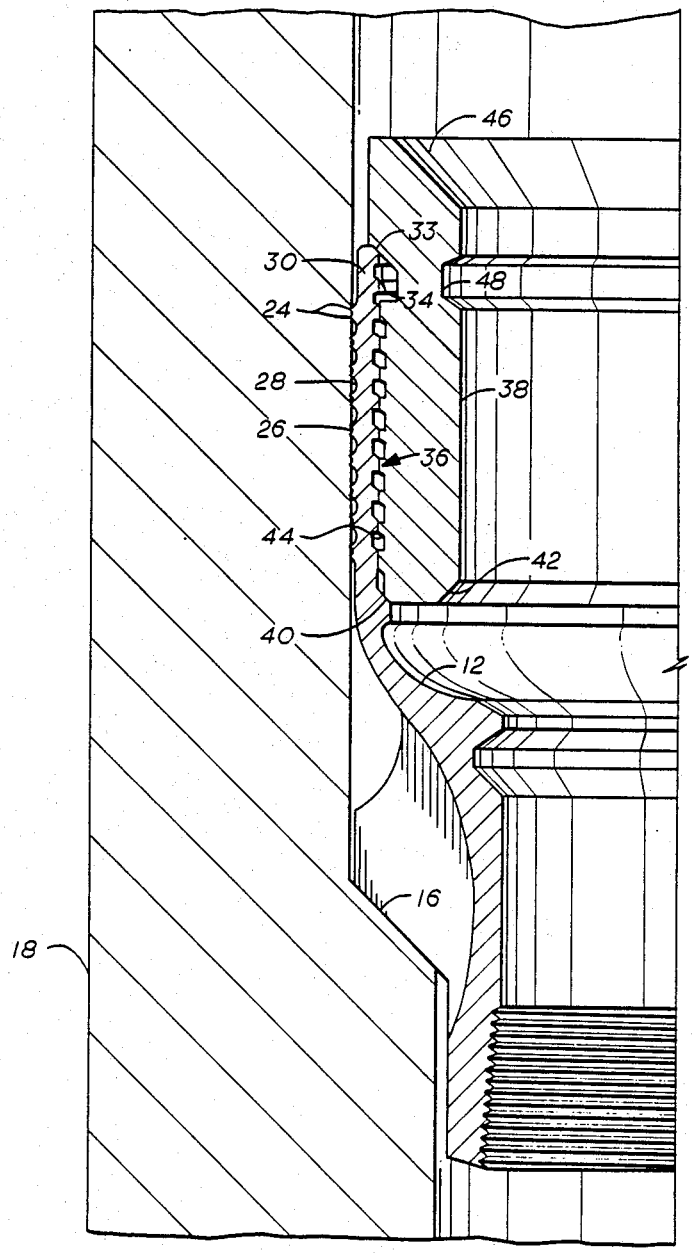
FIG. 5 is a partial sectional view of the improved hanger and seal in their set position after the forming tool has been retrieved.

With the completion of the forming step, forming tool T and its running string are retrieved and hanger 10 remains within wellhead housing in its set position as illustrated in FIG. 5.

While the foregoing describes the sharp teeth 24 as being on the exterior of rim 20, the exterior of rim 20 may be smooth and sharp teeth may be provided on the interior of subsea wellhead housing to provide the desired gripping and sealing engagement after the actuating ring and the forming tool have acted upon the rim.

What is claimed is:

1. A hanger for supporting a tubular string within a subsea well and landing on an internal landing seat within a wellhead housing comprising a body having an external tapered landing shoulder for landing on the landing seat of the wellhead housing, a lower connecting means for supporting a tubular string below said body and an upstanding sealing rim, said sealing rim including external gripping and sealing means and internal camming surfaces, and an actuating ring positioned within said rim and having external camming surfaces mating and coacting with the rim internal camming surfaces, downward movement of said actuating ring with respect to said rim wedging said rim outward into partial set position, said actuating ring having sufficient yieldability for pressure forming by the application of pressure to the interior of said actuating ring for displacing said actuating ring and said rim into deformed positions radially outward of their initial positions.

2. A hanger according to claim 1 wherein said gripping and sealing means includes a plurality of sharp teeth on the exterior surface of said rim.

3. A hanger according to claim 1 wherein said gripping and sealing means includes a plurality of pairs of sharp teeth on the exterior surface of said sealing rim, each of said pairs of sharp teeth being separated by a recess having a substantially greater dimension than the dimension between the sharp teeth of each pair.

4. A hanger according to claim 1 including an upper internal tapered shoulder on said rim which tapers downwardly and inwardly, and an external tapered shoulder on said actuating ring which tapers downwardly and inwardly to mate with said tapered shoulder on said rim, engagement of said shoulder forming a stop to the downward movement of said actuating ring.

5. A hanger according to claim 1 wherein said camming surfaces on the interior of said rim are threads having an upper surface, a lower surface, an outer surface and a recess surface with the upper surface of each thread projection being tapered to provide the camming surfaces, the lower surface of each thread projection being undercut, the outer surfaces being vertically extending surfaces and the recess surface between the upper and lower surfaces of each thread projection being a vertically extending surface, the threads on said actuating ring being mating threads to the threads on said sealing rim.

6. A hanger according to claim 5 wherein said gripping and sealing means includes a plurality of pairs of sharp teeth on the exterior surface of said rim, and said camming surfaces on said rim are directly within said rim from said pairs of sharp teeth.

7. A subsea wellhead structure comprising a wellhead housing having an internal tapered landing seat and an internal cylindrical surface above said seat, a hanger having a tubular body with an external tapered landing shoulder for landing and being supported by said housing landing seat and with an upstanding sealing rim, said sealing rim including external gripping and sealing means and internal camming surfaces, an actuating ring positioned within said rim and having external camming surfaces mating and coacting with the rim internal camming surfaces, the taper of said camming surfaces being downwardly and inwardly so that downward movement of said actuating ring with respect to said rim causes a wedging of said rim outward into tight engagement with the interior surface of said housing, said actuating ring being sufficiently yieldable so that when subjected to substantial internal pressure it displaces said rim radially outward to bring its gripping and sealing means into tight gripping and sealing engagement with said internal cylindrical surface of said housing.

* * * * *